United States Patent [19]

Yazawa et al.

[11] 4,090,442

[45] May 23, 1978

[54] HAND STAMP

[76] Inventors: Toshio Yazawa; Fumi Yazawa, both of No. 6-11-15, Motogou, Kawaguchi-shi, Saitama-ken, Japan

[21] Appl. No.: 777,941

[22] Filed: Mar. 16, 1977

[30] Foreign Application Priority Data

Mar. 23, 1976 Japan ..... 51-34679[U]

[51] Int. Cl.[2] ..... B41J 1/60

[52] U.S. Cl. ..... 101/111; 101/405

[58] Field of Search ..... 101/111, 110, 105, 405

[56] References Cited

U.S. PATENT DOCUMENTS

| | | | |
|---|---|---|---|
| 1,093,485 | 4/1914 | Scotford et al. | 101/111 |
| 1,219,384 | 3/1917 | Ellis | 101/111 |
| 2,193,564 | 3/1940 | Melind | 101/111 |
| 2,853,002 | 9/1958 | Robinson | 101/111 |
| 3,269,306 | 8/1966 | Smilgys | 101/110 |
| 3,338,160 | 8/1967 | Heil | 101/111 X |
| 3,587,457 | 6/1971 | Morris | 101/110 |
| 3,741,114 | 6/1973 | Maul et al. | 101/110 |
| 3,908,543 | 9/1975 | Wirth | 101/110 |
| 4,004,506 | 1/1977 | McInerny | 101/110 |

*Primary Examiner*—Clifford D. Crowder
*Attorney, Agent, or Firm*—Eliot S. Gerber

[57] ABSTRACT

An improved hand stamp for numbering, dating, etc. is provided. The stamp has printing belts, a shaft and a plurality of polygonal members. The shaft has a protrusion along the entire length, and the polygonal members have a through-hole and a plurality of grooves on the circumferential surface of the through-hole such that the position of the polygonal members may be fixed by an engagement between the protrusion and the grooves. The printing belts are rotated by a rotation of the polygonal members about the shaft against the engagement between the protrusion and the grooves.

2 Claims, 3 Drawing Figures

HAND STAMP

BRIEF SUMMARY OF THE INVENTION

The present invention relates to an improved hand stamp for stamping many kinds of legends such as numerals for date, time, price, etc.

Conventionally, in a known hand stamp, a plurality of ring-like belts are provided side by side, on each of which are disposed printing legends or indicia (for example, numerals 0 to 9) at the predetermined intervals on the outer surface of the ring-like belts. The belts are tightly held by rotary discs or rings, and the desired numerals or printing legends are arranged by rotating the rotary discs together with the ring-like belts.

However, according to the conventional stamp, when the discs as well as the ring-like belts are rotated to obtain the predetermined printing legends in position, it has been troublesome and awkward to arrange the predetermined printing legends in alignment side by side by rotating the rotary discs while watching the bottom surface of the stamp. Further once a predetermined legend of the printing belt is arranged by a fingertip operation, the arranged legend is apt to be disarranged or disordered when the predetermined other legends in the adjacent printing belts are being arranged because the fingers are likely to touch with the arranged printing belt. Accordingly the arranged ring-like belt is disarranged and therefore should be arranged again. Furthermore, the ring-like printing belts, which are arranged, are slightly disordered or disarranged while stamping operation is successively conducted. Therefore, the legends which are arranged in position get out of position.

Accordingly, an object of the present invention is to provide an improved hand stamp which allows an easy positioning operation.

Another object of the present invention is to provide an improved hand stamp which allows a stable stamping operation without a danger of disarrangement of the legends in use.

Further object of the present invention is to provide an improved hand stamp which can be manufactured at lower cost and assembled with ease.

Other objects and features of the present invention will become apparent from the detailed description of the preferred embodiment thereof, which will be read with the accompanying drawings.

DETAILED DESCRIPTION OF THE INVENTION

Figure 1:
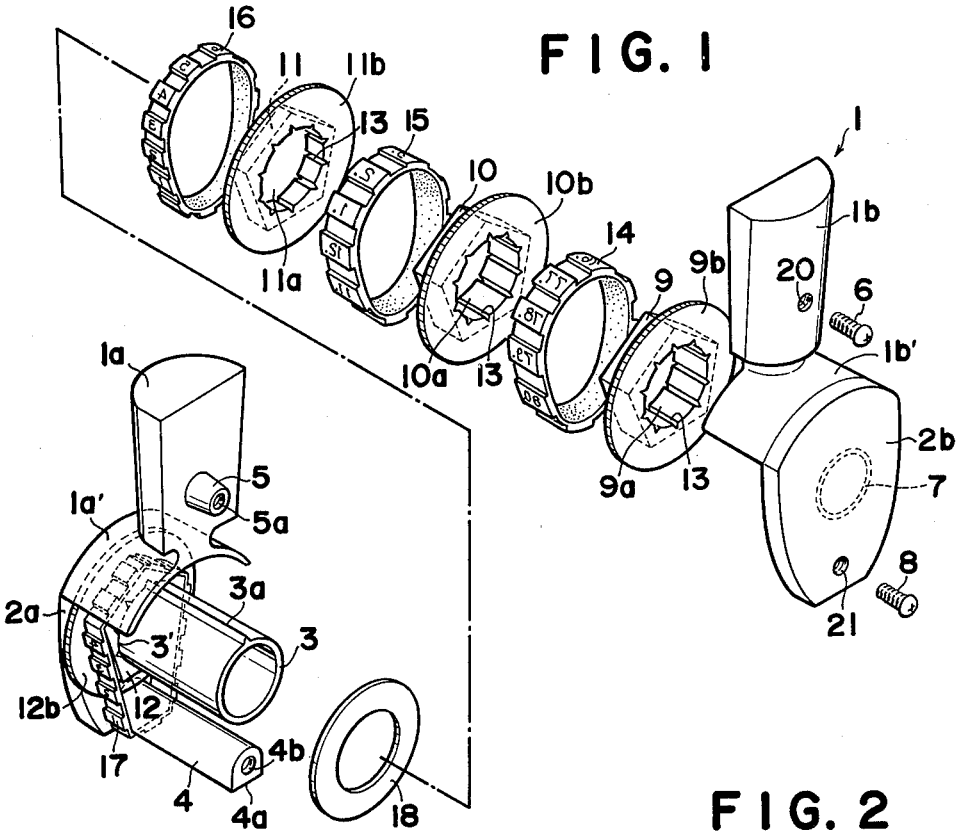
FIG. 1 is a fragmentarily sectioned view of parts of the hand stamp embodying the present invention.
Figure 2:
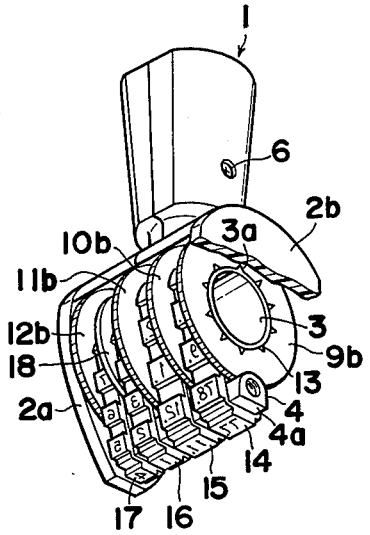
FIG. 2 is a perspective view of the stamp assembled with the parts shown in FIG. 1.

In FIGS. 1 and 2, a frame body 1 has two handle portions 1*a* and 1*b* which have extensions 1*a*' and 1*b*', and walls 2*a* and 2*b* at the outer extremity of the extensions 1*a*' and 1*b*'. The walls 2*a* and 2*b* are connected with the outer end of the extensions, as shown in FIG. 1. A cylindrical member 3 is fixed at its one end 3' to one of the walls, the wall 2*a* in FIG. 1. Below the cylindrical member 3 is disposed a bar member 4, one end of which is fixed to the lower portion of the wall 2*a*. The bar member 4 has, at its bottom, a flat surface 4*a* along the entire length of the bar member so that a plurality of ring-like belts, which will be described below, may be firmly contacted with and secured by the bar member 4. Preferably, the aforementioned handle portions 1*a*, extension 1*a*', wall 2*a*, cylindrical member 3 and bar member 4 are integrally made of a suitable plastic material. The bar member 4 has a spiral groove 4*b* at the other end thereof.

The handle portion 1*a* has, at its flat portion, a protrusion 5 which has a spiral groove 5*a* therein. The protrusion 5 is preferably made integral with the handle portion 1*a*. The other handle portion 1*b* has a recess (not shown) at its flat surface and has a hole 20 through which a screw 6 is inserted and then engaged with the spiral groove 5*a* of the opposite sided handle portion 1*a*. Thus, the two handle portions 1*a* and 1*b* are removably fixed to each other such that the protrusion 5 of the handle portion 1*a* is positioned within the aforementioned recess (not shown) of the handle portion 1*b*. The recess is large enough to allow an insertion of the protrusion, and is aligned with the center of the hole 20. The wall 2*b* has a cylindrical protrusion 7, which is illustrated by phantom lines in FIG. 1, at the substantially center portion. The cylindrical protrusion 7 has an outer diameter which is substantially the same as the inner diameter of the aforementioned cylindrical member 3 such that the protrusion 7 is snugly fixed with the other end of the cylindrical member 3. The cylindrical protrusion is preferably made integral with the wall 2*b*. Below the portion where the cylindrical protrusion is fixed, a hole 21 is formed in such a manner that the wall 2*b* is removably fixed to the bar member 4 by means of a screw 8 which will be engaged with the spiral groove 4*b* of the bar member 4. Thus, the handle portion 1*a* and wall 2*a* are removably fixed to the other handle portion 1*b* and wall 2*b*.

The cylindrical member 3 has a longitudinal protrusion 3*a* at the uppermost outer surface along the entire length of the cylindrical member as well illustrated in FIG. 1. The protrusion 3*a* is formed in parallel with an axis of the cylindrical member 3 and with the longitudinal direction of the bar member 4. The protrusion 3*a* is formed integral with the cylindrical member 3 and has a triangle shape in cross section.

Regular polygonal members, which are of regular pentagonal shape in this embodiment, are rotatably disposed about the fixed cylindrical member 3. Each of the regular pentagonal members 9, 10, 11 and 12 has, at its center portion, a round shaped hole (9*a*, 10*a*, 11*a*) which has a diameter substantially the same as the maximum outer diameter, namely the outer diameter including the protrusion 3*a*, of the cylindrical member 3. Ten grooves 13 are radially formed, with the predetermined interval, on the round surface of each hole of the regular pentagonal members 9, 10, 11 and 12. The groove 13 has a triangular shape in cross section such that the protrusion 3*a* of the cylindrical member 3 is snugly secured within the groove 13. Each of the pentagonal members 9, 10, 11 and 12 has five sides each of which is long and wide enough to fully position and receive the two numerals ("1" and "2", for example) thereon. The number of the grooves 13 is twice as many as the number of sides of the members 9, 10, 11 and 12. Namely in this embodiment, ten grooves are formed since the members 9, 10, 11 and 12 are pentagonal. The pentagonal members 9, 10, 11 and 12 have annular members 9*b*, 10*b*, 11*b* and 12*b* such that each of the annular members is fixed to one of the pentagonal members. The annular members 9*b*, 10*b*, 11*b* and 12*b* have minor grooves or convex and concaves of the outer circumferential area thereof so that finger-tips will not slide out in operation. A ring 18 is provided between the pentagonal member 12 and the pentagonal member 11 to achieve an operational separation of a printing belt 17 and an adjacent printing belt 16. This is due to the fact that pentagonal members 9, 10 and 11 face one side whereas the pentagonal member 12, which is positioned adjacent to the wall 2*a*, faces the other side. Thus, a separate movement or operation of the printing belts 14, 15, 16 and 17 will be carried out without disturbing or influencing the adjacent printing belts. The printing belts which are made of rubber have legends, i.e., numerals on the outer surface thereof at the predetermined interval. The printing belts are well known in the art, and detailed description will not be made.

the printing belts 14, 15, 16 and 17 are tightly suspended by the pentagonal members 9, 10, 11 and 12 on one side and the bar member 4 on the other.

In operation, the annular members are rotated by a finger-tip operation until the predetermined legends are positioned on the flat surface 4*a* of the bar member 4 against the resilient force of the printing belts. When the predetermined legends are positioned accurately on the flat surface of the bar member 4, the protrusion 3*a* of the cylindrical member 3 will be immediately and snugly engaged with one of the grooves 13 of the pentagonal members 9, 10, 11 and 12. Thus, the engagement between the protrusion 3*a* and the groove 13 is enforced by the resilient force of the printing belts.

Figure 3:
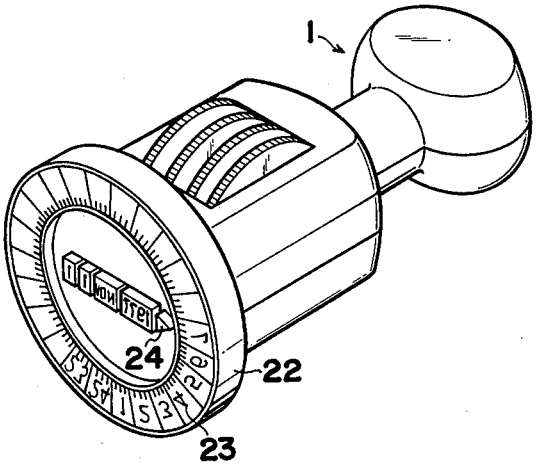
FIG. 3 is a perspective view of other type of hand stamp.

The structure of the stamp of present invention will be applied for another type of a stamp which is shown in FIG. 3. The stamp 1 of FIG. 3 is similar with that of FIGS. 1 and 2, but has a rotary table 22 at the bottom thereof. On the bottom surface of the rotary table 22, numerals 23 which represent 24 hours of a day and a member 24 are formed so that the predetermined time is stamped as well as the other printing legends. This type of the stamp is well known in the art, and any further detailed description will not be made.

Though the present invention has been described with reference to preferred embodiment thereof many modifications and alternatives may be made within the spirit of the invention.

What is claimed is:

1. A hand stamp comprising:

a first side member;

a second side member;

a bar member releasably connected with an end of said first and second side members;

said bar member having a flat bottom surface along the entire length thereof, a cylindrical shaft releasably connected with said first and second side members;

said shaft having a single protrusion on the outer surface thereof, said protrusion extending along the entire length of said shaft and having a triangular shape in cross-section, said protrusion being formed integral with said shaft, a plurality of polygonal members each having a through-hole at the center thereof for inserting said shaft therethrough and a plurality of grooves having a triangular shape corresponding to said protrusion in cross-section at spaced intervals on the circumferential surface of said through-hole, thereby releasably engaging said shaft with said polygonal members;

a plurality of printing belts having printing characters;

said printing belts being tightly suspended by said polygonal members and said bar member, and a plurality of annular members each being connected with one side of one of said polygonal members, wherein said grooves are two times the number of angles of said respective polygonal members, said first and second side members each having a handle portion integral therewith, said handle portions being releasably connected together to form a handle of said stamp.

2. The stamp according to claim 1, in which said polygonal members are regular pentagonal whereas said grooves are ten.

* * * * *